US010519622B2

(12) United States Patent
Caillieret et al.

(10) Patent No.: US 10,519,622 B2
(45) Date of Patent: Dec. 31, 2019

(54) EXCAVATOR ARM, EXCAVATOR CANTILEVER MEMBER INCLUDING SUCH AN EXCAVATOR ARM AND EXCAVATOR INCLUDING SUCH AN EXCAVATOR CANTILEVER MEMBER

(71) Applicant: VOLVO CONSTRUCTION EQUIPMENT AB, Eskilstuna (SE)

(72) Inventors: Roger Caillieret, Brens (FR); Yvan Iarussi, Maillat (FR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 245 days.

(21) Appl. No.: 15/536,023

(22) PCT Filed: Dec. 16, 2014

(86) PCT No.: PCT/IB2014/003085
§ 371 (c)(1),
(2) Date: Jun. 14, 2017

(87) PCT Pub. No.: WO2016/097784
PCT Pub. Date: Jun. 23, 2016

(65) Prior Publication Data

US 2017/0335541 A1 Nov. 23, 2017

(51) Int. Cl.

| | |
|---|---|
| ***E02F 3/42*** | (2006.01) |
| ***E02F 3/32*** | (2006.01) |
| ***E02F 3/38*** | (2006.01) |

(52) U.S. Cl.
CPC ..... *E02F 3/425* (2013.01); *E02F 3/32* (2013.01); *E02F 3/38* (2013.01)

(58) Field of Classification Search
CPC ..... E02F 3/32; E02F 3/38; E02F 3/425; E02F 9/123
(Continued)

(56) References Cited

U.S. PATENT DOCUMENTS

2014/0205412 A1 7/2014 Bienfang

FOREIGN PATENT DOCUMENTS

| | | |
|---|---|---|
| CN | 2739236 Y | 11/2005 |
| CN | 101307610 A | 11/2008 |

(Continued)

OTHER PUBLICATIONS

International Search Report (dated Aug. 9, 2015) for corresponding International App. PCT/IB2014/003085.

(Continued)

*Primary Examiner* — Saul Rodriguez
*Assistant Examiner* — Brendan P Tighe
(74) *Attorney, Agent, or Firm* — Sage Patent Group

(57) ABSTRACT

An excavator arm includes at least: a frame including i) a boom linkage part to swingably link excavator arm to an excavator boom about a boom axis, and ii) a tool linkage part to swingably link the excavator arm to a tool about a tool axis, the boom axis and the tool axis extending in a frame plane, an arm linear actuator extending along a longitudinal axis, the arm linear actuator having i) a proximal linkage pan linked to the frame about a proximal linkage axis and ii) a distal linkage part linked to the frame about a distal linkage axis, the proximal linkage axis and the distal linkage axis extending in an actuator plane, and an electric motor configured to drive the arm linear actuator. Electric motor is arranged between the frame plane and the actuator plane.

18 Claims, 5 Drawing Sheets

(58) Field of Classification Search
USPC ..... 414/687
See application file for complete search history.

(56) References Cited

FOREIGN PATENT DOCUMENTS

| | | | |
|---|---|---|---|
| CN | 203008004 | U | 6/2013 |
| EP | 1126086 | A1 | 8/2001 |
| WO | 2013114451 | A1 | 8/2013 |
| WO | WO 2013114451 | A1 | 8/2013 |

OTHER PUBLICATIONS

Chinese Official Action (dated Nov. 22, 2018) for corresponding Chinese App. 201480084111.3.

EXCAVATOR ARM, EXCAVATOR CANTILEVER MEMBER INCLUDING SUCH AN EXCAVATOR ARM AND EXCAVATOR INCLUDING SUCH AN EXCAVATOR CANTILEVER MEMBER

BACKGROUND AND SUMMARY

The present invention relates to an excavator arm configured to equip an excavator. Besides, the present invention relates to an excavator cantilever member including such an excavator arm. Furthermore, the present invention relates to an excavator including such an excavator cantilever member.

The invention can be applied in construction equipment machines, such as mechanical shovels or drillers and any other type of excavator. Such excavator may be a tracked swilling excavator comprising either a caterpillar track or wheels, and a cantilever member coupled to a rotating platform mounted on the caterpillar track. The invention can be applied also to wheeled excavators and or to backhoe loaders. Although the invention will be described with respect to a mechanical shovel, the invention is not restricted to this particular construction equipment, but may also be used in other construction equipment machines.

WO 13114451A1 discloses an excavator arm including an arm linear actuator and an electric motor driving the arm linear actuator. However, the electric motor is located on the outer region of the excavator arm, that is the region which is oriented away from the excavator cab when the excavator cantilever member is folded.

Such a location of the electric motor entails a risk of impact against external, surrounding objects on the jobsite. In order to decrease such a risk, the excavator arm of W013114451A1 has a casing designed to protect the electric motor and the major part of the arm linear actuator.

Yet, such a casing cannot protect the electric motor against any big impact. Furthermore, such a casing must be bulky and heavy, thus increasing the overall footprint of the excavator arm and the electricity consumption for operating the excavator.

It therefore appears that, from several standpoints, there is room for improvement in the excavator arm of an excavator.

It is desirable to provide an excavator arm having a light and compact design and nonetheless suitable for preventing the risk of impact of the electric motor against external, surrounding objects on the jobsite.

According to an aspect of the invention, an excavator arm, configured to equip an excavator, is provided said excavator arm including at least:

a frame comprising i) a boom linkage part configured to swingably link said excavator arm to an excavator boom about a boom axis, and ii) a tool linkage part configured to swingably link said excavator arm to a tool about a tool axis, said boom axis and said tool axis substantially extending in a frame plane, an arm linear actuator extending substantially along a longitudinal axis, said arm linear actuator having i) a proximal linkage part linked to said frame about a proximal linkage axis and ii) a distal linkage part linked to said frame about a distal linkage axis, said proximal linkage axis and said distal linkage axis extending substantially in an actuator plane, and an electric motor configured to drive said arm linear actuator, wherein said electric motor is arranged on the side of said frame plane with respect to said actuator plane.

Throughout the present application, the adjective "proximal" pertains to an element which is relatively close to an upper swing unit of the excavator, whereas the adjective "distal" pertains to an element which is relatively far from the upper swing unit. Hence, a proximal part of the excavator arm is closer to the upper swing unit than a distal part of the excavator arm.

By the provision of such an excavator arm, the advantage is that the electric motor is protected from any impact on the jobsite, while the excavator arm can be compact and light compared to the excavator arm of W013114451A1.

The tool linked to the excavator arm can be any kind of tool usually implemented on mechanical construction equipment. For instance, the tool can be selected from the group including a bucket, a drilling tool, a hammer and a gripping tool. Such tools can be attached to the excavator arm via an appropriate link configured to provide a quick coupling, be it hydraulic, electric and/or mechanic, between the excavator arm and the tool. Usually, the tool is mounted at the tip of the excavator arm.

According to a variant, said arm linear actuator comprises a reversible mechanical linear actuator. For instance said arm linear actuator can comprise a ball screw, a roller screw or a buttress thread screw, the screw imparting translation to a linear actuator rod by a nut. Such a mechanical linear actuator can be maintained in any given position, regardless of the forces applied thereon, by simply stopping its drive by the electric motor, whereas hydraulic linear actuators of the prior art require several cumbersome check valves to be maintained in a given position. Besides, a reversible mechanical linear actuator has the ability to recover energy when load is driving the movement. Furthermore, a reversible mechanical linear actuator avoids the transfer of excessive mechanical load to the structure of the excavator.

Alternatively, said arm linear actuator can comprise an irreversible mechanical linear actuator.

As the arm linear actuator can be driven by the electric motor, it can reach very accurate positions, produce a high torque and exert the same force during a pulling step as during a pushing step, unlike a hydraulic linear actuator of most prior art excavator arms.

According to an embodiment, said electric motor is substantially arranged between said frame plane and said actuator plane.

Throughout the present application, the term "substantially arranged" means that the electric motor can be i) either entirely arranged between frame plane and actuator plane, ii) or mostly arranged between frame plane and actuator plane while part of the electric motor is located beyond the frame plane or beyond the actuator plane.

According to an embodiment, said proximal linkage part is located at a first end portion of said arm linear actuator, and wherein said distal linkage part is located at a second end portion of said arm linear actuator.

Thus, such locations of the proximal and distal linkage parts permit to use the arm linear actuator at its full length, hence with a maximal strength.

According to an embodiment, the excavator arm further comprises a gearbox configured to transmit power from said electric motor to said arm linear actuator, said gearbox being located at said proximal linkage part.

Thus, such a gearbox permits to control the power applied from the electric motor to the arm linear actuator.

According to an embodiment, said electric motor extends along a motor axis which is substantially parallel to said longitudinal axis, and wherein said gearbox is located at said proximal linkage part.

Thus, such an arrangement of the electric motor, along the arm linear actuator, permits the excavator arm to be compact in a lateral direction.

According to an embodiment, said motor axis and said longitudinal axis extend on both sides (right and left sides) of a median plane which contains said longitudinal axis and which is perpendicular to said actuator plane. Possibly, said motor axis and said longitudinal axis can extend symmetrically with respect to said median plane.

Thus, such an arrangement of the electric motor, in the middle of the excavator arm, permits the excavator arm to be very compact in a lateral direction, perpendicular to the median plane.

Alternatively, the electric motor can be offset with respect to the median plane. In other words, the electric motor can be arranged on a side of the excavator arm.

According to an embodiment, said proximal linkage axis is transversal to said longitudinal axis, wherein said distal linkage axis is transversal to said longitudinal axis.

Thus, such proximal and distal linkage axes permit a simple construction and maneuver of the excavator arm.

According to a variant, said proximal linkage axis is perpendicular to said longitudinal axis, and said distal linkage axis is perpendicular to said longitudinal axis.

According to an embodiment, said frame defines a cavity which opens on at least one side, said electric motor being at least partly received in said at least one cavity.

Such a cavity is defined by some walls or plates of the frame. For instance, the cavity can be defined by the first and second side plates and by the lower plate.

Advantageously, the frame defines a cavity in which is received at least 50%, preferably 80%, most preferably 100%, of the volume of the electric motor, and possibly of the volume of a gearbox.

Thus, such an open structure permits easy check, repair and replacement of the arm linear actuator or of the said electric motor.

According to an alternative embodiment, said frame has a generally closed structure encasing at least said arm linear actuator and said electric motor.

According to an embodiment, said frame comprises at least:

a first side plate and a second side plate located respectively on each side of said electric motor, said first side plate and said second side plate extending at least from said boom linkage part to said tool linkage part, and a proximal stiffener transversally joining said first side plate and said second side plate, said proximal stiffener extending from a boom connection part which is configured for connecting a boom linear actuator fastened to the excavator boom, and a distal stiffener transversally joining said first side plate and said second side plate, said distal stiffener extending substantially from said tool axis and substantially parallel to said arm linear actuator.

Thus, the proximal stiffener can provide a high mechanical strength to a proximal portion of the excavator arm.

Likewise, the distal stiffener extending along or parallel to the line of action of the arm linear actuator provides a high mechanical strength to a distal portion of the excavator arm, since the distal stiffener extends along or parallel to the line of action of the arm linear actuator.

According to an embodiment, said proximal stiffener extends along a direction parallel to a line connecting said boom connection part to said boom axis. Thus, the proximal stiffener provides a high mechanical strength to a proximal portion of the excavator arm, since the proximal stiffener extends along or parallel to the line of action of the boom linear actuator.

According to an embodiment, said proximal stiffener transversally joins said first side plate and said second side plate, at least a part of said proximal stiffener forming a substantially closed hollow box.

Thus, such a shape can provide the proximal stiffener with a high ratio of its quadratic moments to its weight.

The proximal stiffener can have a plate-like extension protruding from said substantially closed hollow box. Advantageously, said substantially closed hollow box can have the general shape of a triangle.

In particular, said proximal stiffener can have a triangular portion located near said boom connection part, and a cantilever portion located away from said boom connection part.

According to an embodiment, said distal stiffener joins said first side plate and said second side plate, said distal stiffener substantially defining a closed hollow structure with said lower plate.

According to a variant, said distal stiffener has a length ranging from 30% to 70% of the length measured between the tool axis and the boom axis.

Thus, such a shape can provide the distal stiffener with a high ratio of its quadratic moments to its weight.

According to an embodiment, said frame further comprises a lower plate extending between said first side plate and said second side plate, for instance from said first side plate to said second side plate, such that said electric motor is located between said lower plate and said arm linear actuator.

Thus, such a lower plate reinforces the mechanical strength of the excavator arm, in particular by increasing its quadratic moment about a lateral direction. Furthermore, such a lower plate protects the electric motor from under the excavator arm against external, surrounding objects.

According to an embodiment, said first side plate and said second side plate have symmetrical shapes with respect to a median plane which contains said longitudinal axis and which is perpendicular to said actuator plane.

Thus, such symmetrical first and second side plates can provide the excavator arm with a uniform mechanical strength.

According to an embodiment, said first side plate and said second side plate have:

respective proximal portions extending relatively close to the boom axis, respective distal portions extending relatively close to the tool axis, and respective intermediate portions extending between said respective proximal portions and said respective distal portions, wherein a distal width measured between said respective distal portions is smaller than a proximal width measured between said respective proximal portions, said respective intermediate portions forming a narrowing, preferably tapered, cross-section of said frame.

Thus, such proximal, intermediate and distal portions provide the excavator arm with a uniform mechanical strength, while maintaining a low weight.

According to a variant of the invention, said first side plate, said second side plate, said proximal stiffener and said distal stiffener are metallic, preferably made of steel.

According to a variant of the invention, the proximal portions are higher than the distal portions the height being measured substantially perpendicular to the frame plane. A height ratio of the proximal portions to the distal portions can range from 2 to 4.

According to another aspect of the invention, an excavator cantilever member is provided including at least an excavator boom and an excavator arm according to the present invention, said excavator boom and said excavator arm being swingably linked about said boom axis, said excavator boom being configured such that a tip portion of said excavator boom is arranged, along said boom axis, between said first side plate and said second side plate.

In other words, the excavator arm forms a clevis mounting, or a fork joint, for the excavator boom. The side plates of the excavator boom are partially covered respectively by the first side plate and the second side plate.

Thus, such a clevis mounting permits to reduce the lateral footprint of the boom.

According to an embodiment, the tool is a bucket, said bucket being linked to said excavator arm.

According to another aspect of the invention, an excavator is provided including a lower driving unit, an upper swing unit turnably mounted on the lower driving unit and an excavator cantilever member, wherein said excavator cantilever member includes at least an excavator boom and an excavator arm according to the present invention, said excavator boom being swingably mounted to the upper vehicle unit.

Thus, such an excavator can have an excavator arm equipped with an electric motor, which is fully protected from impact against outer objects while providing some advantages. For instance, the linear actuator can exert the same force during a pulling step as during a pushing step, unlike a hydraulic linear actuator where the piston rod impinges on the cross-section area of the piston rod chamber but not on the cross-section area of the bottom chamber.

Within the scope of the present invention, the aforementioned embodiments and variants can be considered either in isolation or in any technically possible combination.

BRIEF DESCRIPTION OF THE DRAWINGS

The features and advantages of the present invention will also appear upon reading the following description in view of the appended drawings, which represent, as non-limiting examples, an embodiment of an excavator arm according to the invention.

The following detailed description of several embodiments of the invention is better understood when read in conjunction with the appended drawings. However, the invention is not limited to the specific embodiments disclosed herewith.

DETAILED DESCRIPTION OF EXAMPLE EMBODIMENTS OF THE INVENTION

Figure 13:
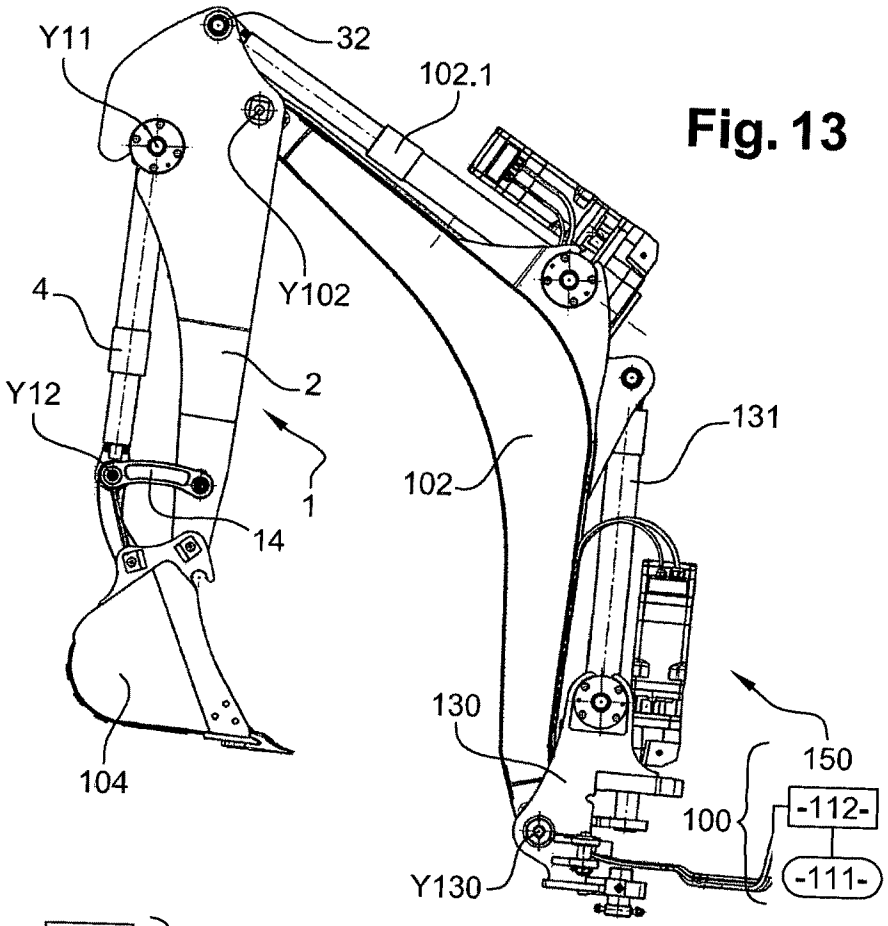
FIG. 13 is a schematic side view of the excavator of FIG. 12.
Figure 12:
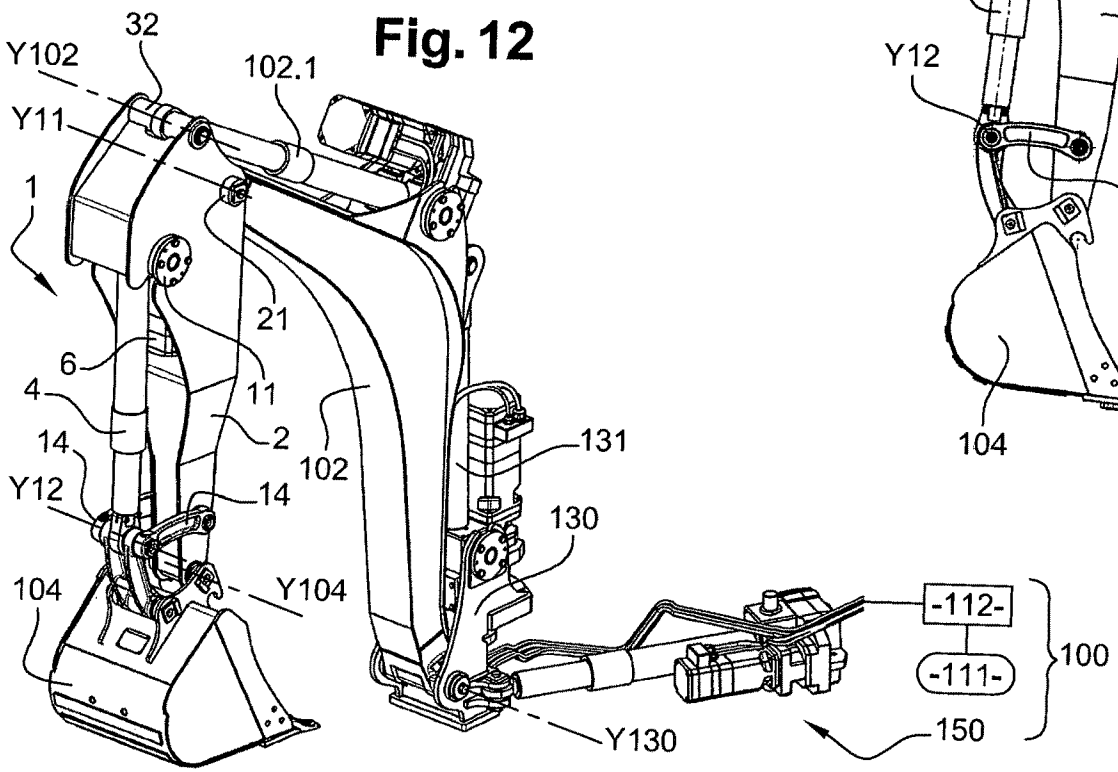
FIG. 12 is a schematic perspective view of an excavator according to one embodiment of the invention and including an excavator cantilever member according to one embodiment of the invention.
Figure 14:
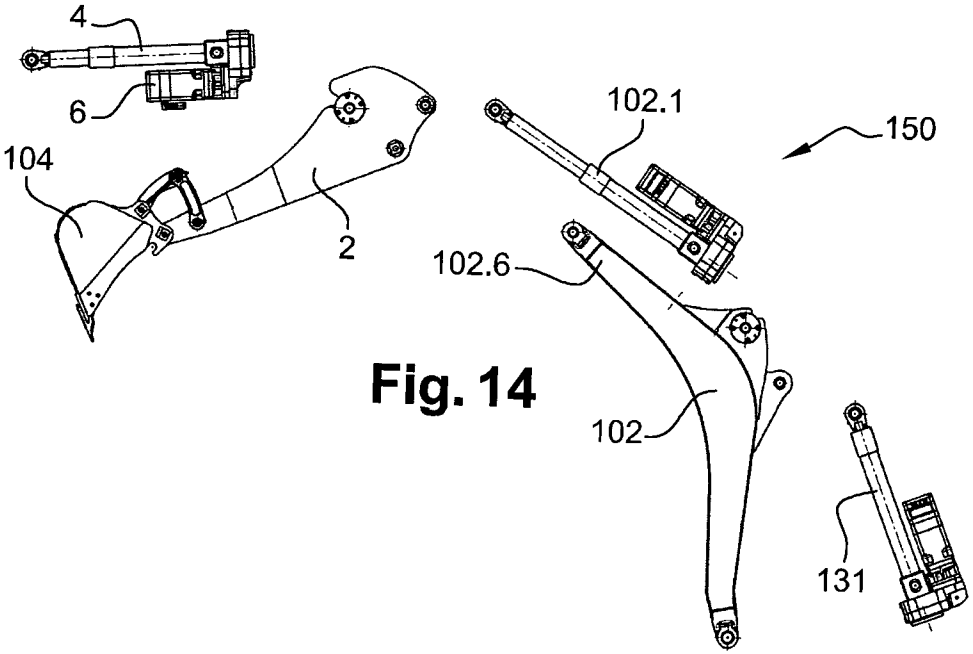
FIG. 14 is a schematic exploded side view of the excavator of FIG. 12.
Figure 15:
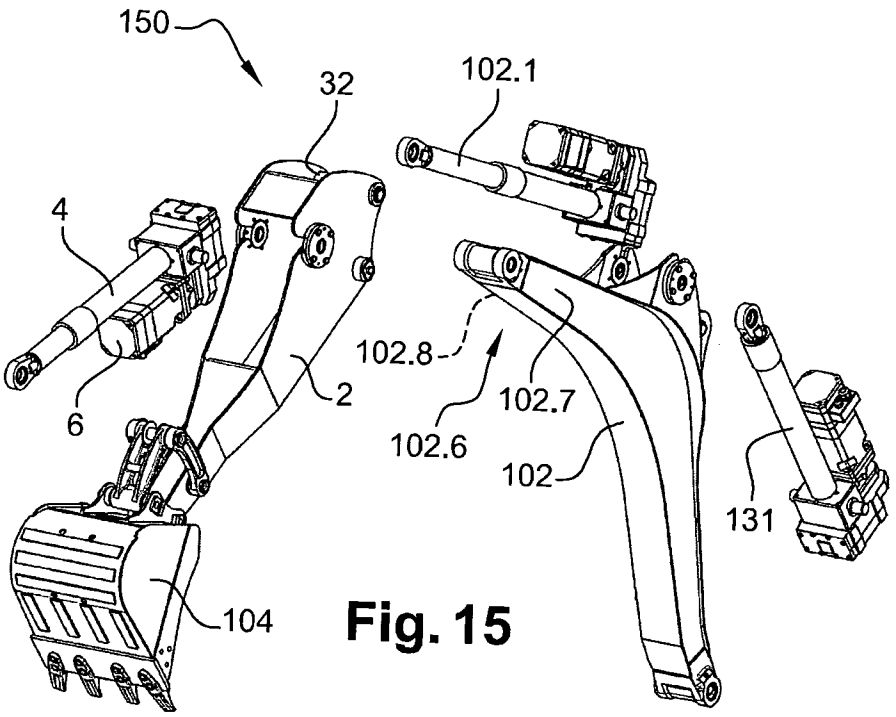
FIG. 15 is a schematic exploded perspective view of the excavator of FIG. 12.

FIGS. 1 to 11 illustrate an excavator arm 1, which is configured to equip an excavator 100 illustrated on FIGS. 12 and 13. Excavator arm 1 includes a frame 2, an arm linear actuator 4 and an electric motor 6 configured to drive the arm linear actuator 4.

Frame 2 comprises:

i) a boom linkage part 21 configured to swingably link excavator arm 1 to an excavator boom 102, visible on FIGS. 12 and 13, about a boom axis Y102, and ii) a tool linkage part 22 configured to swingably link excavator arm 1 to a tool 104 about a tool axis Y104.

Boom linkage part 21 can comprise a boom hinge configured to swingably receive a complementary part of boom 102. The boom hinge enables the boom linkage part 21 to swing with respect to the complementary part of boom 102 about boom axis Y102. Likewise, tool linkage part 22 can comprise a tool hinge configured to swingably receive a complementary part of tool 104. The tool hinge enables the tool linkage part 22 to swing with respect to the complementary part of tool 104 about tool axis Y104. In the example of FIGS. 1 to 11, the tool 104 is a bucket.

Alternatively, boom linkage part 21 can comprise any bearing means suitable for rotatably bearing a part of boom 102. Likewise, tool linkage part 22 can comprise any bearing means suitable for rotatably bearing a part of tool 104.

The boom axis Y102 and the tool axis Y104 extend substantially in a frame plane FP. Boom axis Y102 and tool axis Y104 are herein coplanar, as they are substantially parallel.

Electric motor 6 can be of any suitable kind. Electric power can be supplied to electric motor 6 by a non illustrated electric accumulator which can for instance be mounted on a chassis of excavator 100. Electric motor 6 in turn supplies mechanical power to the gearbox 6.4, hence to the arm linear actuator 4.

The arm linear actuator 4 has two main, telescopic parts which are mounted in a telescopic arrangement and which may be displaced lengthwise by the electric motor 6 so as to vary the length of arm linear actuator 4. A mechanism links the two parts of arm linear actuator 4 in order to convert a rotary motion of the electric motor 6 in a linear relative displacement of the two telescopic parts. Such a mechanism can be of the roller screw type.

The arm linear actuator 4 extends substantially along a longitudinal axis X4. Arm linear actuator 4 has:

i) a proximal linkage part 11 linked to frame 2 about a proximal linkage axis Y11 and ii) a distal linkage part 12 linked to frame 2 about a distal linkage axis Y12.

Proximal linkage part 11 can comprise a buckle configured to receive a complementary hinge fastened to frame 2. Likewise, distal linkage part 12 can comprise a buckle configured to receive a complementary hinge fastened to frame 2.

Alternatively, proximal linkage part 11 can comprise any bearing means suitable for rotatably bearing a part of frame 2. Likewise, distal linkage part 12 can comprise any bearing means suitable for rotatably bearing a part of frame 2. The bearing means enable proximal linkage part 11 and distal linkage part 12 to rotate with respect to frame 2, respectively about proximal linkage axis Y11 and distal linkage axis Y12.

In the example of FIGS. 1 to 11, frame 2 further includes two primary link levers 14 configured to bear the proximal linkage part 11 of arm linear actuator 4. Primary link levers 14 extend approximately perpendicular to longitudinal axis X4. Primary link levers 14 are rotatably connected to frame 2. Primary link levers 14 belong to a link mechanism, which further comprises two secondary link levers pivotally connected, on one side, to the free end of primary link levers 14 and, on the other side, to the tool 104. The arm linear actuator 4 controls position of tool 104 with respect to frame 2 through the link mechanism.

Proximal linkage axis Y11 and distal linkage axis Y12 extend substantially in an actuator plane AP. Proximal linkage axis Y11 and distal linkage axis Y12 are herein coplanar, as they are substantially parallel.

The proximal linkage axis Y11 is transversal to the longitudinal axis X4. Likewise, the distal linkage axis Y12 is transversal to said longitudinal axis X4.

Figure 1:
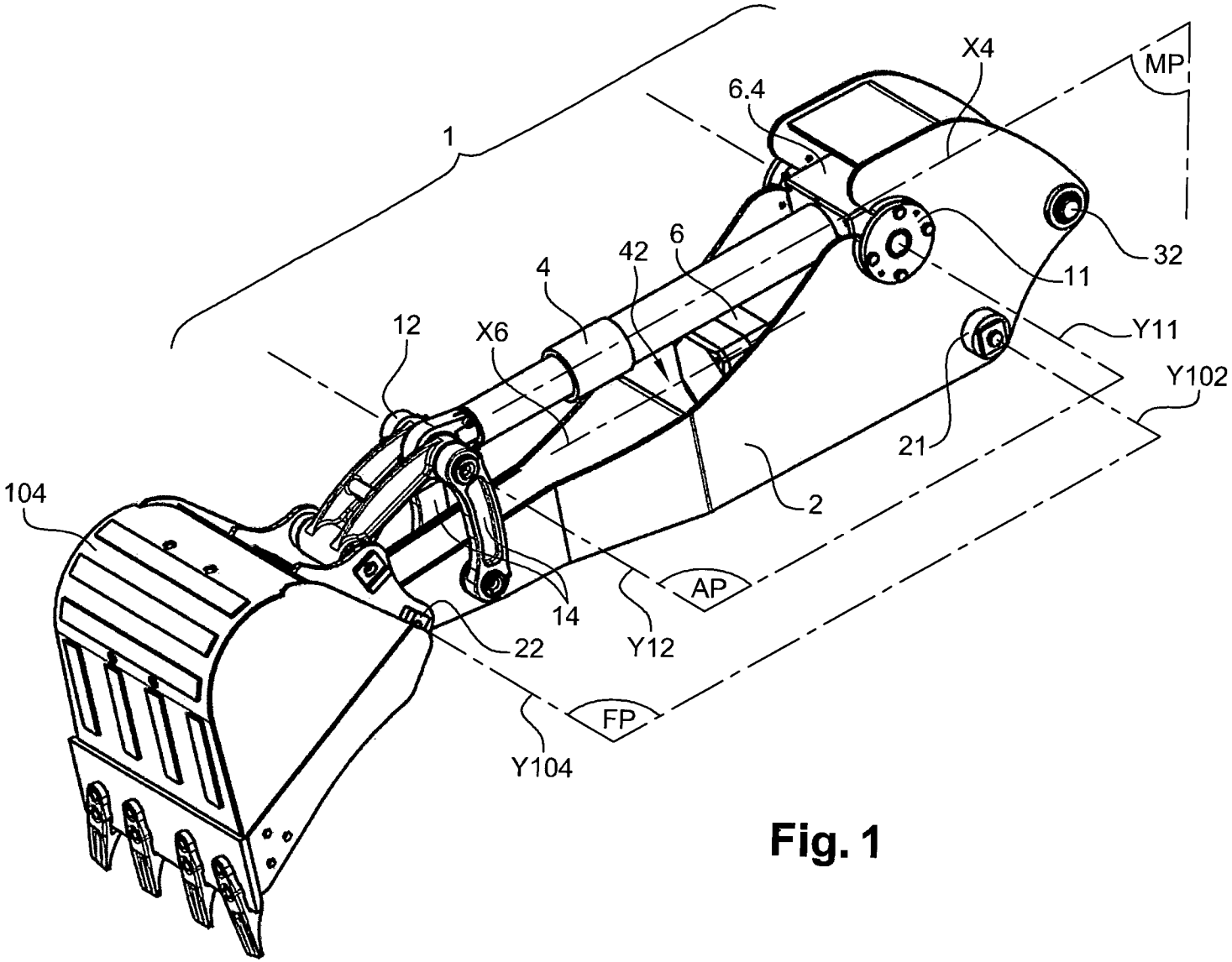
FIG. 1 is a schematic perspective view of an excavator arm according to bodiment of the invention.
Figure 3:
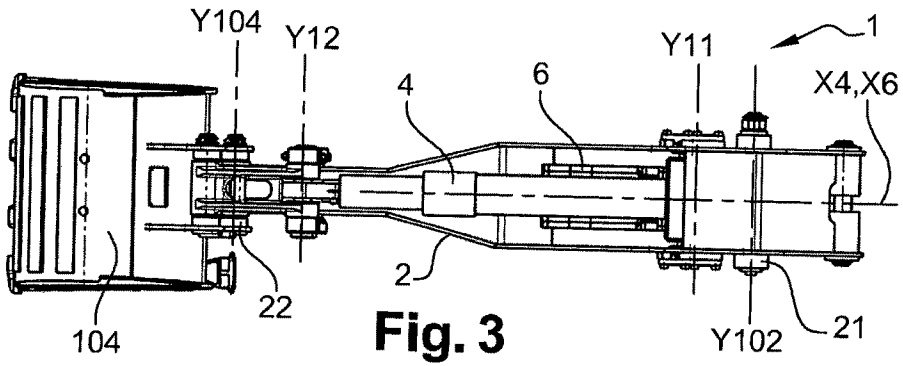
FIG. 3 is a schematic top view of the excavator arm of FIG. 1.
Figure 2:
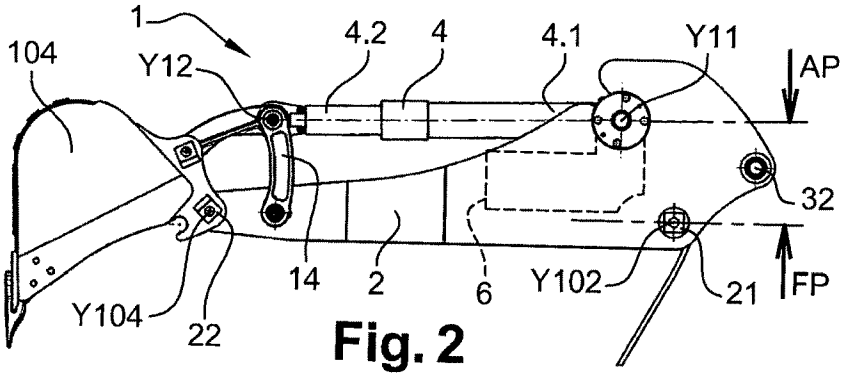
FIG. 2 is a schematic side view of the excavator arm of FIG. 1.

As visible on FIGS. 1 and 2, the electric motor 6 is arranged on the side of frame plane FP with respect to actuator plane AP. In particular, the electric motor 6 is arranged between the frame plane FP and the actuator plane AP. In other words, electric motor 6 is located in a region extending from the frame plane FP to the actuator plane AP.

In the example of FIGS. 1 to 11, the arm linear actuator 4 is a mechanical linear actuator comprising a non illustrated roller screw.

Figure 5:
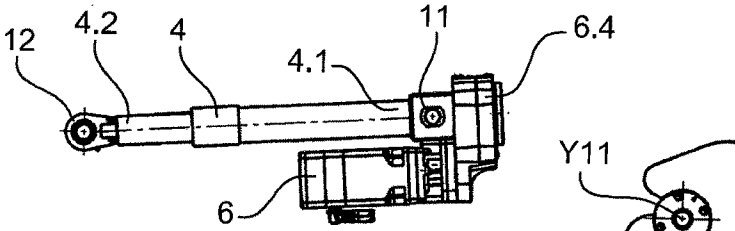
FIG. 5 is a schematic exploded side view of the excavator arm of FIG. 1.
Figure 5:
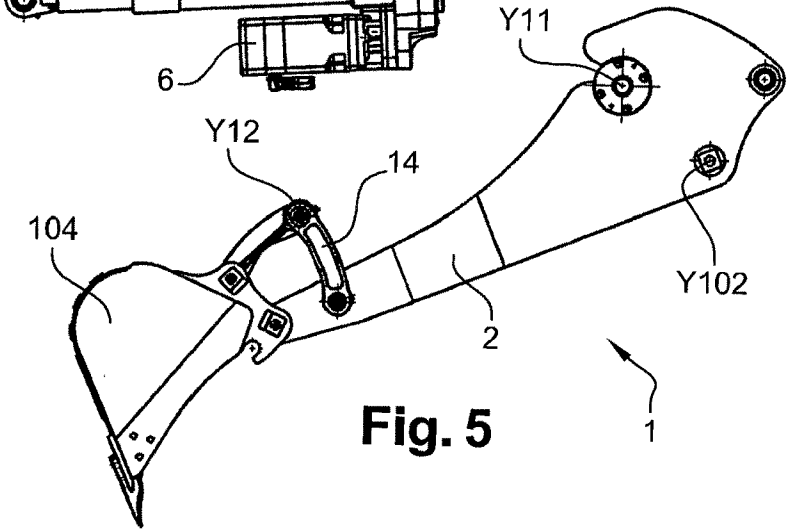
Figure 4:
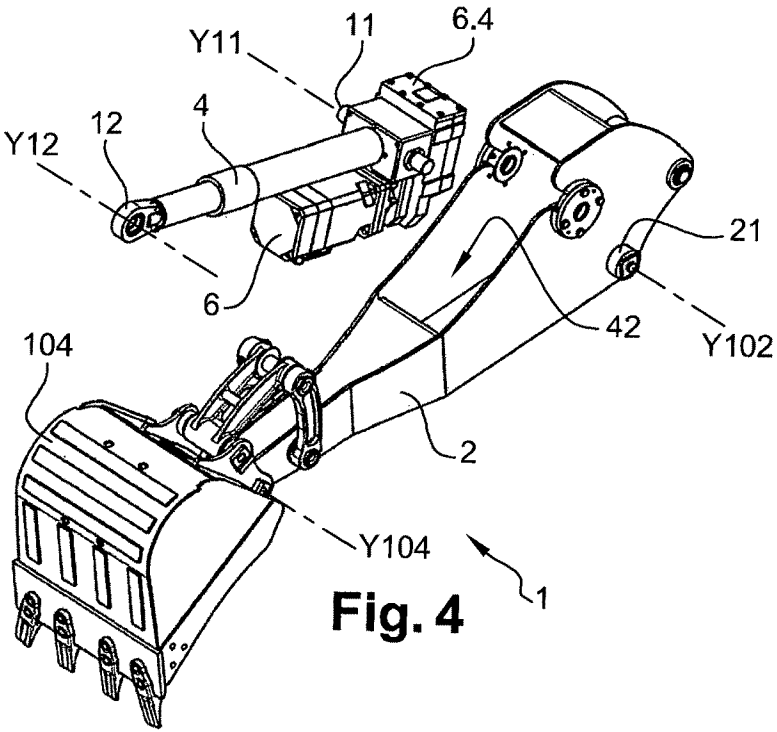
FIG. 4 is a schematic exploded perspective view of the excavator arm of FIG. 1.
Figure 6:
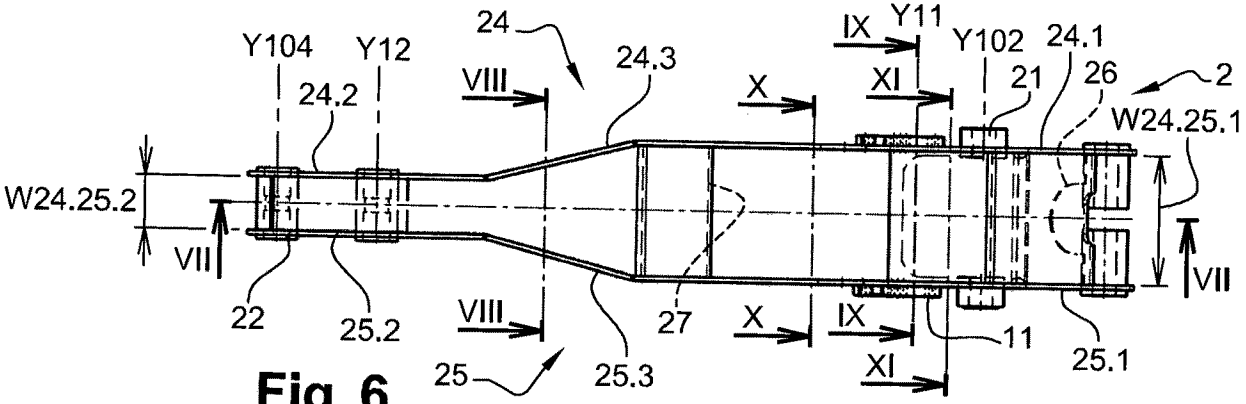
FIG. 6 is a schematic top view of the frame of the excavator arm of FIG. 1.
Figure 7:
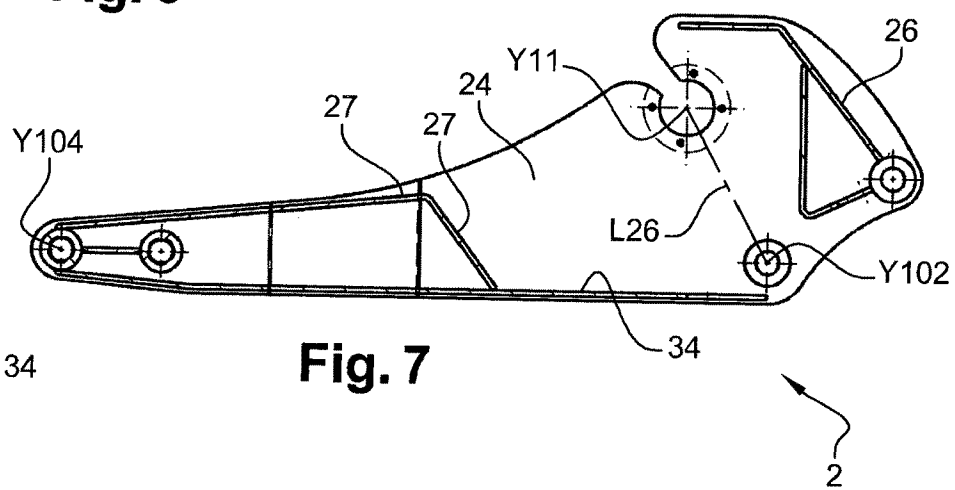
FIG. 7 is a schematic cross-sectional view along line VII-VII at FIG. 6.
Figure 9:
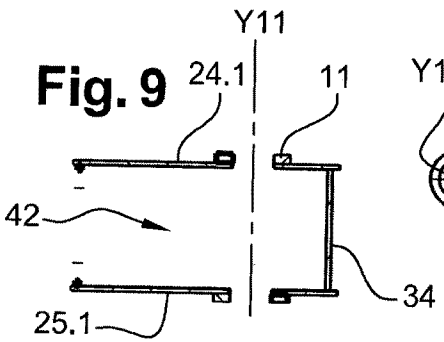
FIG. 9 is a schematic cross-sectional view along line IX-IX at FIG. 6.
Figure 11:
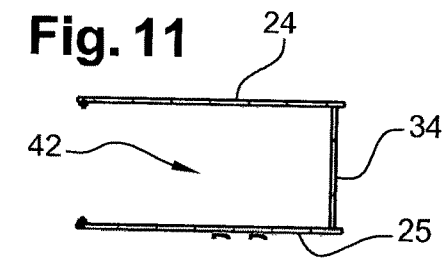
FIG. 11 is a schematic cross-sectional view along line XI-XI at FIG. 6.
Figure 8:
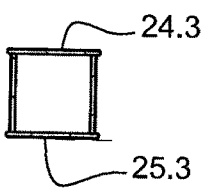
FIG. 8 is a schematic cross-sectional view along line VIII-VIH at FIG. 6.
Figure 10:
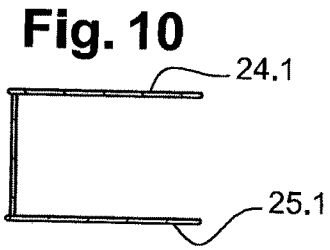
FIG. 10 is a schematic cross-sectional view along line X-X at FIG. 6.

As visible on FIG. 5, the proximal linkage part 11 is located at a first end portion 4.1 of arm linear actuator 4 and the distal linkage part 12 is located at a second end portion 4.2 of arm linear actuator 4.

The excavator arm 1 further comprises a gearbox 6.4 configured to transmit power from electric motor 6 to arm linear actuator 4. The gearbox 6.4 is located at the proximal linkage part 12. Gearbox 6.4 is secured to arm linear actuator 4 so as to extend along longitudinal axis X4. Gearbox 6.4 can be of any suitable kind.

Electric motor 6 extends along a motor axis X6 which is substantially parallel to longitudinal axis X4. The motor axis X6 and the longitudinal axis X4 extend symmetrically on both sides (right and left sides) of a median plane MP which contains the longitudinal axis X4 and which is perpendicular to the actuator plane AP.

Frame 2 has a generally open structure which is configured to enable access to the arm linear actuator 4 and/or to the electric motor 6. As visible on FIGS. 6 to 11, frame 2 defines a cavity 42 which opens on its upper side, i.e. towards arm linear actuator 4. The electric motor 6 is wholly received in cavity 42. In other words, frame 2 defines cavity 42 such that 100% of the volume of the electric motor 6 is received in cavity 42. Likewise, 100% of the volume of gearbox 6.4 is received in cavity 42. The frame 2 comprises a first side plate 24, a second side plate 25, a proximal stiffener 26 and a distal stiffener 27.

First side plate 24 and second side plate 25 are located respectively on each side of the electric motor 6. First side plate 24 and said second side plate 25 extend from the boom linkage part 21 to the tool linkage part 22.

The proximal stiffener 26 transversally joins first side plate 24 and second side plate 25. Proximal stiffener 26 is rigidly connected to first side plate 24 and to second side plate 25, for example by welding, bolting, riveting or any equivalent means. Proximal stiffener 26 extends from a boom connection part 32 which is configured for connecting a boom linear actuator 102.1, visible on FIGS. 12 to 15, fastened to the excavator boom 102. Proximal stiffener 26 extends along a direction parallel to a line L26 connecting the proximal linkage axis Y11 to the boom axis Y102.

Boom connection part 32 can comprise a rotation bearing, like a hinge or a pivot. The boom linear actuator 102.1 is configured to swing or rotate excavator arm 1 with respect to boom 102.

In the example of FIGS. 1 to 11, proximal stiffener 26 transversally joins first side plate 24 and second side plate 25. Part of proximal stiffener 26 forms a substantially closed hollow box. Proximal stiffener 26 has a triangular portion located near said boom connection part 32, and a cantilever portion located away from said boom connection part.

In the example of FIGS. 1 to 11, the distal stiffener 27 transversally joins first side plate 24 and second side plate 25. Distal stiffener 27 is rigidly connected to first side plate 24 and to second side plate 25, for example by welding, bolting, riveting or any equivalent means. The distal stiffener 27 extends substantially from the tool axis Y104 and substantially parallel to the arm linear actuator 4.

Distal stiffener 27 substantially defines a closed hollow structure with lower plate 34. Distal stiffener 27 has a length equal to about 50% of the length measured between the tool axis Y104 and the boom axis Y102.

Frame 2 further comprises a lower plate 34 which extends between from first side plate 24 to second side plate 25, such that electric motor 6 is located between lower plate 34 and arm linear actuator 4. Lower plate 34 is rigidly connected to first side plate 24 and to second side plate 25, for example by welding, bolting, riveting or any equivalent means.

First side plate 24, second side plate 25, proximal stiffener 26, distal stiffener 27 and lower plate are herein made of plates or webs out of steel.

First side plate 24 and second side plate 25 have symmetrical shapes with respect to median plane MP which contains longitudinal axis X4 and which is perpendicular to actuator plane AP. First side plate 24, second side plate 25, proximal stiffener 26 and distal stiffener 27 are made of steel.

First side plate 24 and second side plate 25 have:

respective proximal portions 24.1 and 25.1, which extend relatively at the boom axis Y102, respective distal portions 24.2 and 25.2, which extend relatively at the tool axis Y104, and respective intermediate portions 24.3 and 25.3, which extend between respective proximal portions 24.1, 25.1 and respective distal portions 24.2, 25.2.

A distal width W24.25.2 measured between respective distal portions 24.2 and 25.2, parallel to tool axis Y104, is smaller than a proximal width W24.25.1 measured between respective proximal portions 24.1 and 25.1, parallel to boom axis Y102.

The respective intermediate portions 24.3, 25.3 form a narrowing, tapered cross-section of frame 2. Indeed, respective intermediate portions 24.3, 25.3 extend obliquely both to the longitudinal axis X4 and to the boom axis Y102.

The proximal portions 24.1, 25.1 are higher than the distal portions 24.2, 25.2, the height being measured substantially perpendicular to the frame plane FP. A height ratio of the height of proximal portions 24.1, 25.1 to the height of distal portions is approximately 4.

FIGS. 12 to 15 illustrate excavator 100 having an excavator cantilever member 150 which includes excavator boom 102, excavator arm 1 and tool 104. Excavator boom 102 and excavator arm 1 are swingably linked about the boom axis Y102, notably by means of the boom connection part 32.

Excavator boom 102 is configured such that a tip portion 102.6 of excavator boom 102 is arranged, along boom axis Y102, between first side plate 24 and second side plate 25. In other words, the excavator arm 1 forms a clevis mounting, or a fork joint, for the excavator boom 102. The side plates 102.7, 102.8 of the excavator boom 102 are covered respectively by the first side plate 24 and the second side plate 25.

Excavator 100 includes a lower driving unit 111, an upper swing unit 112 turnably mounted on the lower driving unit 111 about an axis which is substantially vertical when excavator 100 is placed on a horizontal ground. Excavator 100 further includes an excavator cantilever member 150. Excavator boom 102 is mounted so as to swing relative to the upper vehicle unit 111 around a coupler axis Y130, which is most often horizontal. Further to this first rotation around coupler axis Y130, excavator may provide for a second, optional rotation around a vertical axis between said coupler and upper swing unit 112.

The excavator cantilever member 150 includes a coupler 130 which is configured for coupling boom 102 to the upper vehicle unit 111. The excavator cantilever member 150 further includes a coupler linear actuator 131, which is arranged to rotate boom 102 around coupler axis Y130. Like the arm linear actuator, the boom linear actuator 102.1 and the coupler linear actuator are mechanical linear actuators driven by respective electric motors.

Unlike most prior art hydraulic cylinders of excavator booms, actuator 131 is herein on the upper side of boom 102, i.e. opposite the lower driving unit 111. Conveniently, electric actuator 131 is of the symmetrical type. Actuator 131 is mounted with its electric motor on the upper, outer side with respect to the boom 102.

Upper swing unit 112 can comprise a rotating platform and a cab for the user. Lower driving unit 111 can comprise either a caterpillar track or wheels for driving excavator 100. Lower driving unit 111 can bear a non illustrated electrical accumulator configured to supply electric power to the electric motors, including electric motor 6.

In service on the jobsite, when excavator arm 1 is operated, the electric motor 6 is fully protected from any impact against external, surrounding objects, regardless of the configuration of the excavator cantilever member 150, be it folded, semi-folded or fully extended.

It is to be understood that the present invention is not limited to the embodiments described above and illustrated in the appended drawings. Instead, the skilled person will recognize that many changes and modifications may be made within the scope of the appended claims.

The invention claimed is:

1. An excavator arm, configured to equip an excavator, the excavator arm including at least:

a frame comprising i) a boom linkage part configured to swingably link the excavator arm to an excavator boom about a boom axis, and ii) a tool linkage part configured to swingably link the excavator arm to a tool about a tool axis, the boom axis and the tool axis substantially extending in a frame plane, an arm linear actuator extending substantially along a longitudinal axis, the arm linear actuator having i) a proximal linkage part linked to the frame about a proximal linkage axis and ii) a distal linkage part linked to the frame about a distal linkage axis, the proximal linkage axis and the distal linkage axis extending substantially in an actuator plane, and an electric motor configured to drive the arm linear actuator, wherein the electric motor is arranged on the side of the frame plane with respect to the actuator plane.

2. The excavator arm according to claim 1, wherein the electric motor is substantially arranged between the frame plane and the actuator plane.

3. The excavator arm according to claim 1, wherein the proximal linkage part is located at a first end portion of the arm linear actuator, and wherein the distal linkage part is located at second end portion of the arm linear actuator.

4. The excavator arm according to claim 1, further comprising a gearbox configured to transmit power from the electric motor to the arm linear actuator, the gearbox being located at the proximal linkage part.

5. The excavator arm according to claim 1, wherein the electric motor extends along a motor axis which is substantially parallel to the longitudinal axis, and wherein the gearbox is located at the proximal linkage part.

6. The excavator arm according to claim 5, wherein the motor axis and the longitudinal axis extend on both sides of a median plane which contains the longitudinal axis and which is perpendicular to the actuator plane.

7. The excavator arm according to claim 1, wherein the proximal linkage axis is transversal to the longitudinal axis, wherein the distal linkage axis is transversal to the longitudinal axis.

8. The excavator arm according to claim 1, wherein the frame defines a cavity which opens on at least one side, the electric motor being at least partly received in the at least one cavity.

9. The excavator arm according to claim 1, wherein the frame comprises at least:

a first side plate and a second side plate located respectively on each side of the electric motor, the first side plate and the second side plate extending at least from the boom linkage part to the tool linkage part, and a proximal stiffener transversally joining the first side plate and the second side plate, the proximal stiffener extending from a boom connection part which is configured for connecting a boom linear actuator fastened to the excavator boom, and a distal stiffener transversally joining the first side plate and the second side plate, the distal stiffener extending substantially from the tool axis and substantially parallel to the arm linear actuator.

10. The excavator arm according to claim 9, wherein the proximal stiffener extends along a direction parallel to a line connecting the proximal linkage axis to the boom axis.

11. The excavator arm according to claim 9, wherein the proximal stiffener transversally joins the first side plate and the second side plate, at least a part of the proximal stiffener forming a substantially closed hollow box.

12. The excavator arm according to claim 9, wherein the frame further comprises a lower plate extending between the first side plate and the second side plate, for instance from the first side plate to the second side plate, such that the electric motor is located between the lower plate and the arm linear actuator.

13. The excavator arm according to claim 9, wherein the distal stiffener joins the first side plate and the second side plate, the distal stiffener substantially defining a closed hollow structure with the lower plate.

14. The excavator arm according to claim 9, wherein the first side plate and the second side plate have symmetrical shapes with respect to a median plane which contains the longitudinal axis and which is perpendicular to the actuator plane.

15. The excavator arm according to claim 9, wherein the first side plate and the second side plate have:

respective proximal portions extending relatively close to the boom axis, respective distal portions extending relatively close to the tool axis, and respective intermediate portions extending between the respective proximal portions and the respective distal portions, wherein a distal width measured between the respective distal portions is smaller than a proximal width measured between the respective proximal portions, the respective intermediate portions forming a narrowing, preferably tapered, cross-section of the frame.

16. An excavator cantilever member including at least an excavator boom and an excavator arm according to claim 9, the excavator boom and the excavator arm being swingably linked about the boom axis, the excavator boom being configured such that a tip portion of the excavator boom is arranged, along the boom axis, between the first side plate and the second side plate.

17. An excavator cantilever member according to claim 16, wherein the tool is a bucket, the bucket being linked to the excavator arm.

18. An excavator including a lower driving unit, an upper swing unit turnably mounted on the lower driving unit and an excavator cantilever member, wherein the excavator cantilever member includes at least an excavator boom and an excavator arm according to claim 1, the excavator boom being swingably mounted to the upper swing unit.

* * * * *